US008147256B2

(12) United States Patent
Jin

(10) Patent No.: US 8,147,256 B2
(45) Date of Patent: Apr. 3, 2012

(54) ELECTRICAL CONNECTOR AND TERMINAL THEREOF

(75) Inventor: Zuofeng Jin, Guangzhou (CN)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 12/930,582

(22) Filed: Jan. 11, 2011

(65) Prior Publication Data

US 2011/0256771 A1 Oct. 20, 2011

(30) Foreign Application Priority Data

Apr. 20, 2010 (CN) ..... 2010 2 0170308 U

(51) Int. Cl.
*H01R 12/00* (2006.01)

(52) U.S. Cl. ..... 439/83

(58) Field of Classification Search ..... 439/83, 439/66, 733.1, 824, 81
See application file for complete search history.

(56) References Cited

U.S. PATENT DOCUMENTS 4,726,777 A * 2/1988 Billman et al. ..... 439/70
6,955,572 B1 * 10/2005 Howell ..... 439/862
7,186,152 B2 * 3/2007 Chen ..... 439/733.1
2009/0253287 A1 * 10/2009 Polnyi et al. ..... 439/331
2009/0269950 A1 * 10/2009 Liao et al. ..... 439/66
2009/0311900 A1 * 12/2009 Liao ..... 439/331

FOREIGN PATENT DOCUMENTS

CN 200720056219.9 Y 9/2008

* cited by examiner

*Primary Examiner* — Tulsidas C Patel
*Assistant Examiner* — Harshad Patel
(74) *Attorney, Agent, or Firm* — C. G. Mersereau; Nikolai & Mersereau, P.A.

(57) ABSTRACT

An electrical connector and a terminal are disclosed. The terminal, comprising: a base having an upper end and a lower end; a flexible arm extending upward from the upper end of the base; a retaining portion extending upward from the upper end of the base, wherein a first predetermined distance is between the flexible arm and the retaining portion; a pair of holding legs, each one comprising: a transition arm extending downward from the lower end of the base and a welding portion extending downward from the transition arm; wherein a second predetermined distance is between two transition arms, two welding portions are co-planner and inclined to the base.

18 Claims, 5 Drawing Sheets

ELECTRICAL CONNECTOR AND TERMINAL THEREOF

BACKGROUND OF THE INVENTION

1. Field of the Invention

The present invention relates to an electrical connector and a terminal thereof, and more particularly to a land grid array electrical connector and a terminal thereof for electrically connecting a chip module to a circuit board.

2. Description of the Related Art

Terminals are extensively employed on modern integrated circuit boards to establish electrical connections between electrical components and circuit boards. Conventional connectors are often adapted to the main board via single point welding, which makes the terminal on the circuit board relatively vulnerable when subjected to external force. China patent 200720056219.9 provides an example of the conventional connector and is hereby incorporated by reference. The referenced patent discloses a terminal for an electrical connector. The terminal has a base, and one side of the base extends to form a flexible arm. The flexible arm includes a contact arm that extends upward and a retaining portion that extends downward. The upper end of the base has one upward extension forming a carrier strip connecting portion and one downward extension forming a connecting portion which further extends downward to form a welding portion.

The base is located in a receiving slot of an insulating housing. The contact arm of the terminal extends from the receiving slot and exposes to the outside of the insulating housing. One side of the welding portion of the terminal has a hook for being wedged in a convex portion of the receiving slot to prevent the terminal from moving upward. The retaining portion of the terminal is received in a concave receiving portion of the insulating housing.

The terminal discussed above has the following characteristics. When the contact arm is pressed by an electronic component, at least one part of the fastening portion will contact the interior of the receiving concave portion. The retaining portion can absorb the external force and reduce the stress transmitted to the welding portion, thus minimize the risk of solder-crack. However, the conventional terminal still has the following drawbacks.

On a conventional terminal, such as disclosed in the referenced patent, only has a single welding point, which makes the welding portion relatively weak to external force. When external force is exerted, the soldering material on the welding portion of a conventional terminal may be easily broken, resulting in the welding portion escaping from the circuit board and causing performance deterioration of the electrical connector.

SUMMARY OF THE INVENTION

One particular aspect of the present invention is to provide a terminal that can provide a firm connection to the circuit board.

The terminal, comprising: a base having an upper end and a lower end; a flexible arm extending upward from the upper end of the base; a retaining portion extending upward from the upper end of the base, wherein a first predetermined distance is between the flexible arm and the retaining portion; a pair of holding legs, each one comprising: a transition arm extending downward from the lower end of the base and a welding portion extending downward from the transition arm; wherein a second predetermined distance is between two transition arms, two welding portions are co-planner and inclined to the base.

Another particular aspect of the present invention is to provide an electrical connector that can establish firm connection between an electrical component and a circuit board.

The electrical connector, comprising: an insulating housing having a plurality of receiving slots, wherein the receiving slots are disposed in a staggered configuration; a plurality of terminals, each one received in one corresponding receiving slot, and each of the terminals comprising: a base having an upper end and lower end; a flexible arm extending upward from the upper end of the base; and a retaining portion extending upward from the upper end of the base, wherein a first predetermined distance is between the flexible arm and the retaining portion; and a pair of holding legs, each one comprising: a transition arm extending downward from the lower end of the base; and a welding portion extending downward from the transition arm; wherein a second predetermined distance is between two transition arms, wherein the free end of the flexible arm of the terminal in a row is situated between two adjacent flexible arms of the corresponding terminals in a front adjacent row The electrical connector of the instant disclosure has two welding portions to ensure a firm connection with the circuit board, thereby providing secure connections between the electrical component and the circuit board.

For better understanding of the present invention, reference is made to the following detailed description illustrating the embodiments and examples of the present invention. The description is for illustrative purpose only and is not intended to limit the scope of the claim.

DETAILED DESCRIPTION OF THE PREFERRED EMBODIMENTS

Figure 1:
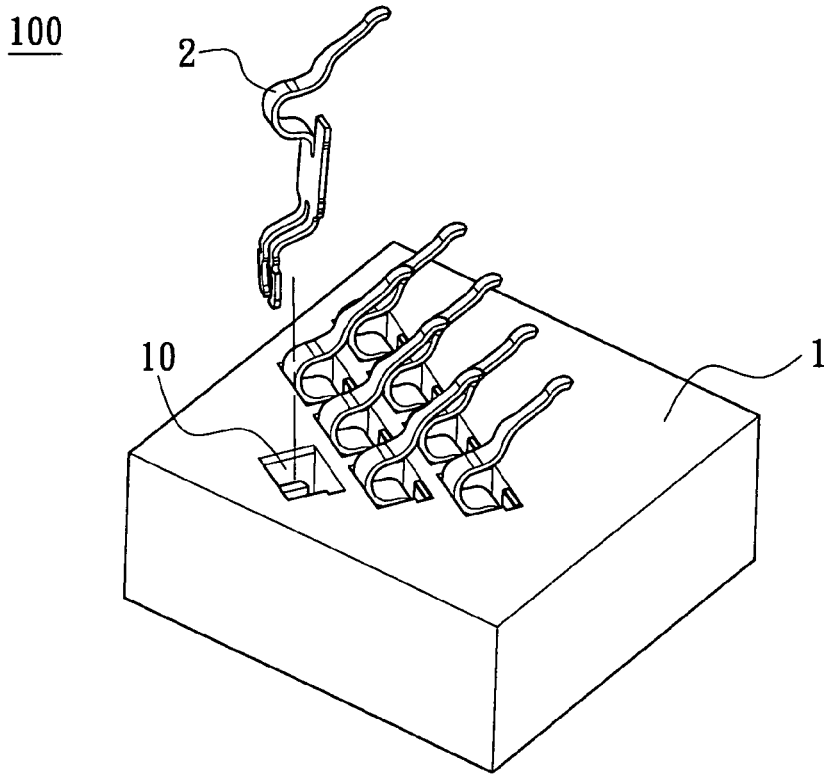
FIG. 1 is a perspective view of an electrical connector of a preferred embodiment of the present invention.
Figure 2:
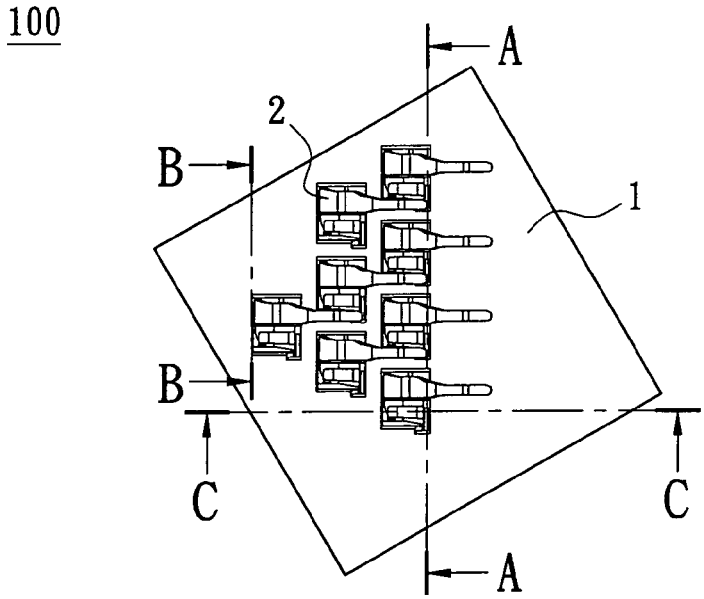
FIG. 2 is a top view of the electrical connector of FIG. 1.

Referring to FIGS. 1 and 2. The electrical connector 100 includes an insulating housing 1 with a plurality of receiving slots 10, a plurality of terminals 2 received in the insulating housing 1, and soldering materials (shown as solder balls 3 in FIG. 8) that located below the terminals 2. A flange extends from the top surface of the insulating housing for receiving a chip module.

Figure 4:
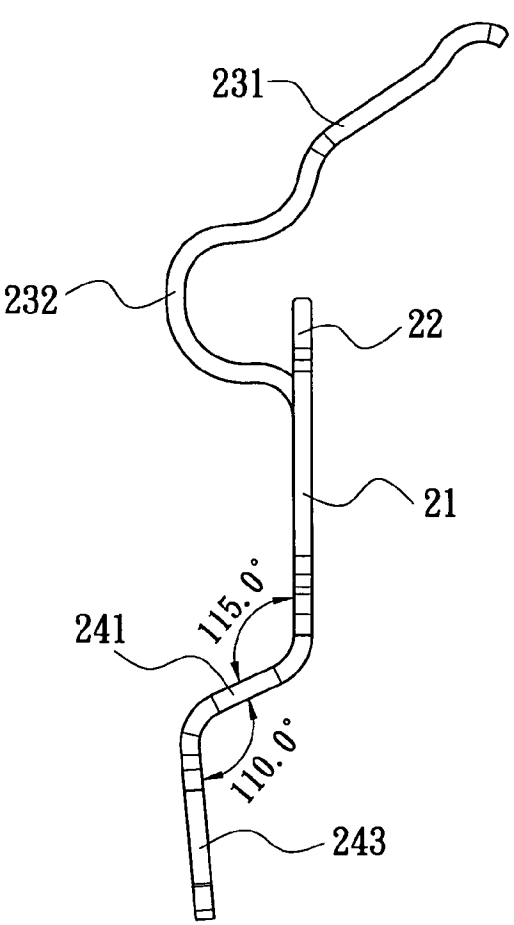
FIG. 4 is a side view of the terminal of FIG. 1.
Figure 3:
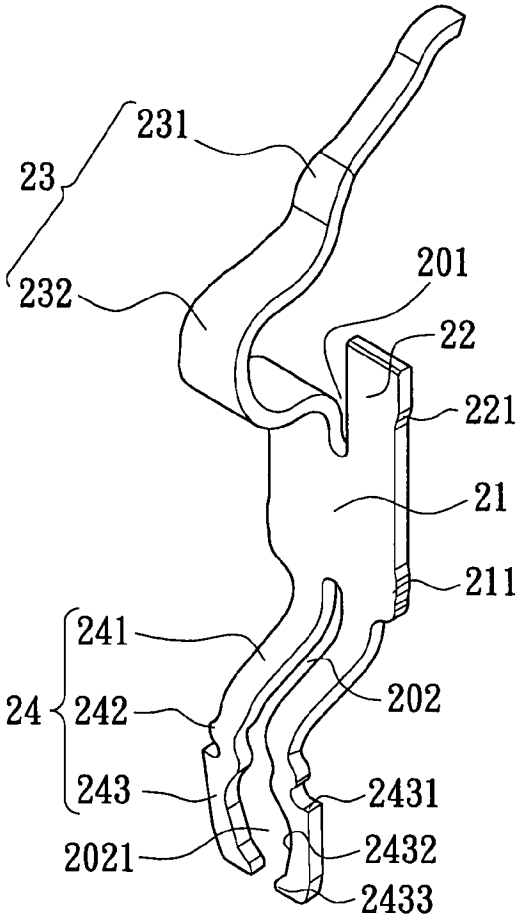
FIG. 3 is a perspective view of the terminal of FIG. 1.

Referring to FIGS. 3 and 4, the terminal 2 includes a flat base 21 having an upper and a lower ends. The upper end of the base 21 has one upward extension forming a retaining portion 22 and one upward extension forming a flexible arm 23. The flexible arm 23 and the retaining portion 22 stand next to each other with a first predetermined distance 201 in between. The upper portion of the retaining portion 22 has a larger width than the lower portion, which forms a gradient 221. The retaining portion 22 and the base 21 are coplanar, but the flexible arm 23 is not. The flexible arm 23 comprises a contact arm 231 and a bending portion 232 extending from the base 21. The outer side edge of the base 21 expands symmetrically outward near the lower end to form an interference portion 211.

The lower end of the base 21 extends downward to form a pair of holding legs 24, and each holding leg 24 comprises a transition arm 241, a blocking portion 242, and a welding portion 243. The pair of transition arms 241 extends downward from the base 21 with a slope and stand next to each other with a second predetermined distance 202 in between. Looking from the side (as shown in FIG. 4), the holding leg 24 and the bending portion 232 are disposed at the same side of the base 21. The transition arms 241 are coplanar, rising from the base 21 at an first angle $\alpha$. In one embodiment, the first angle$\alpha$ is an obtuse angle of 115 degrees (as shown in FIG. 4). The welding portions 243 are also coplanar. The plane on which the welding portion 243 lies forms a second angle $\beta$ with the plane of the transition arm 241 which is smaller than the first angle $\alpha$. The end of the transition arm 241 extends and protrudes outward to form the blocking portion 242, and the blocking portions 242 and the welding portions 243 are coplanar and inclined to the base 21. In between the welding portion 243 and the block portion 242 lies a shoulder 2431. The inner edge 2432 has a shape resembling an arc and the pair of inner edges 2432 looks like a parenthesis (as shown in FIG. 4). The inner edges 2432 of the welding portion 243 thus define a receiving space 2021.

Figure 6:
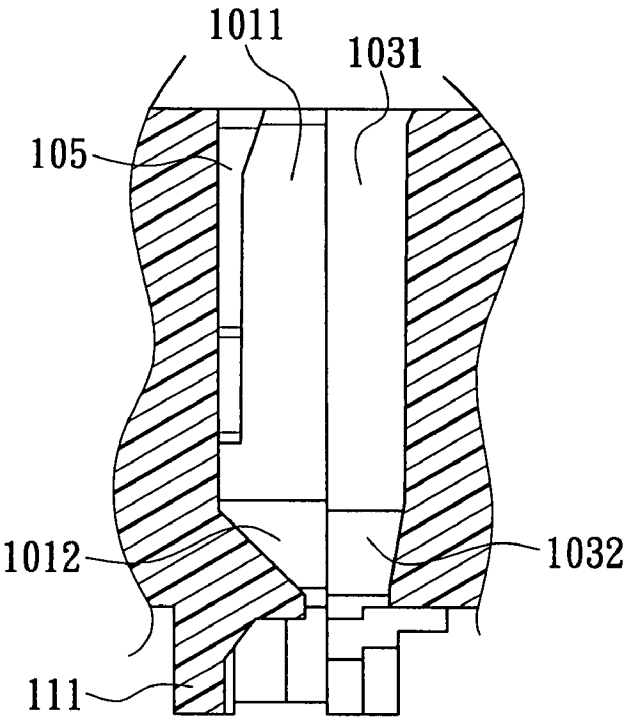
FIG. 6 is a cross-sectional view taken along the line D-D in FIG. 5.
Figure 5:
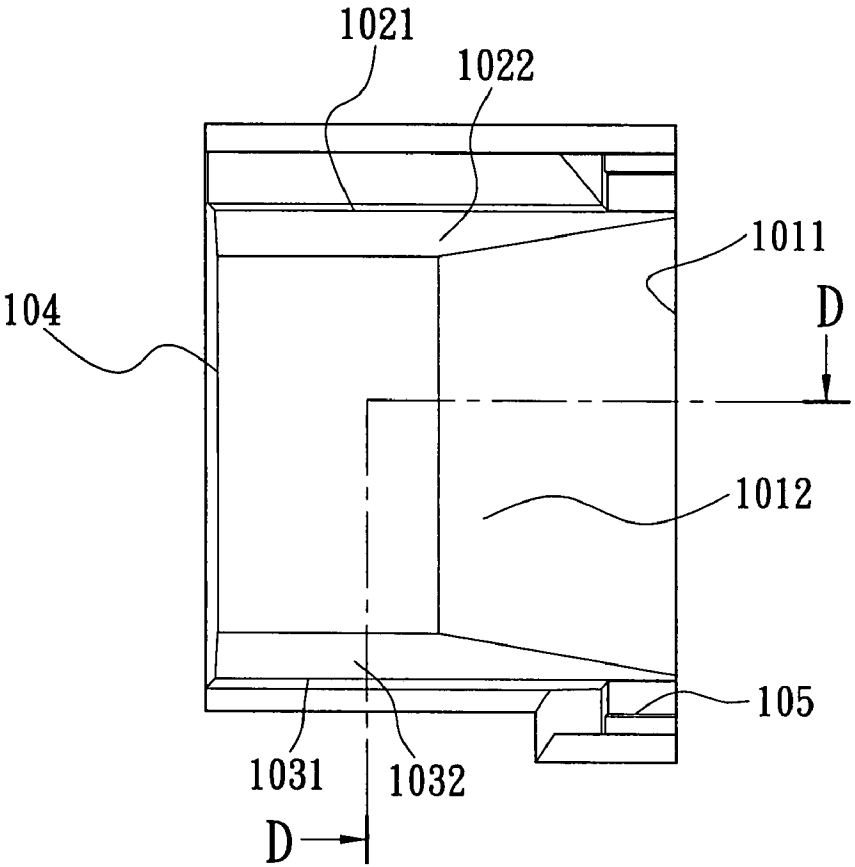
FIG. 5 is a top view of the receiving slot of FIG. 4.

Referring to FIGS. 5 and 6, the insulating housing 1 is a rectangular block having sufficient thickness to host a plurality of receiving slots 10 within, and the receiving slots 10 are disposed in a staggered configuration viewing from the top of the insulating housing 1. Each receiving slot 10 is a through-hole for receiving a terminal 2 correspondingly. Referring to FIG. 5, the opening of the receiving slot 10 is larger near the top surface of the insulating body 1 and smaller near the bottom surface, which forms a funnel-like shape. The receiving slot 10 is formed by a first inner wall, a second inner wall, a third inner wall, and a fourth inner wall (shown as inner wall 104 in FIG. 5). The first inner wall stands opposite to the fourth inner wall 104, and the second inner wall stands opposite to the third inner wall.

Referring to FIGS. 5 and 6, the first inner wall has a first vertical portion 1011 as the upper part and a first sloping portion 1012 as the lower part. The second inner wall has a second vertical portion 1021 as the upper part and a second sloping portion 1022 as the lower part. The third inner wall has a third vertical portion 1031 as the upper part and a third sloping portion 1032 as the lower part. The fourth inner wall 104 has a vertical portion only. The connection portion of the first vertical portion 1011 and the third vertical portion 1031 has a retaining space 105 for receiving the retaining portion 22. The upper part of the retaining space 105 is larger than the lower part for engaging the gradient 221, shown as FIG. 10.

Figure 8:
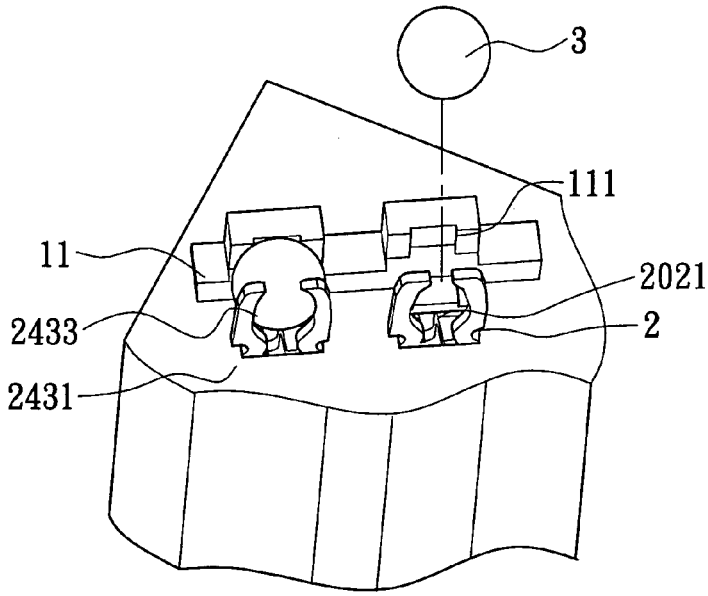
FIG. 8 is another perspective view of the electrical connector of FIG. 1.

Referring to FIG. 8. The bottom face of the insulating housing 1 has bar-shaped platforms 11 protruding from the bottom surface and the platform 11 protrudes downward and extends to form a protrusion portion 111 with a substantially concave surface facing toward the receiving slot 10.

Figure 10:
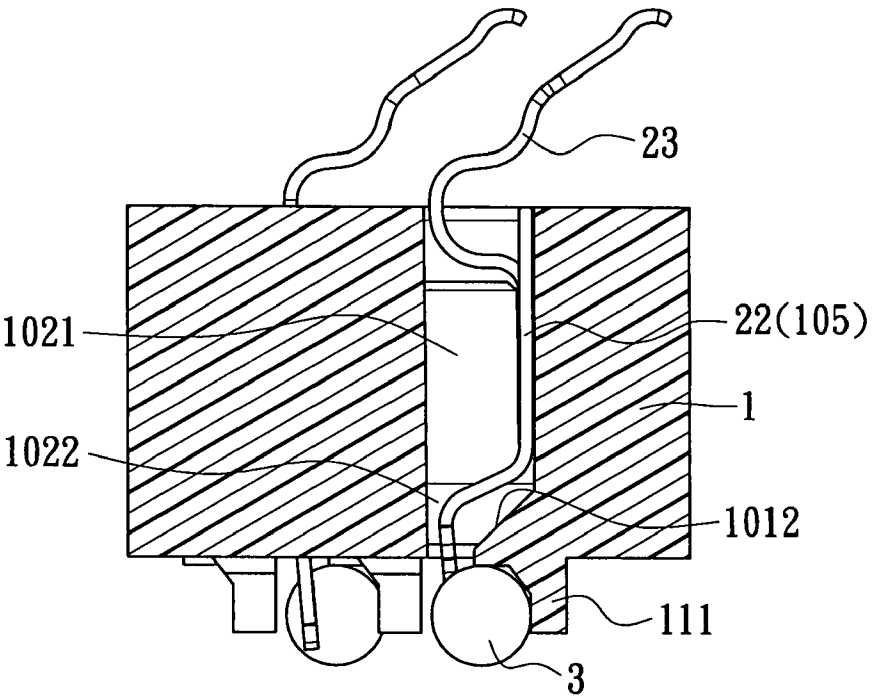
FIG. 10 is a cross-sectional view taken along the line C-C in FIG. 2.

Referring to FIGS. 7-10. When the terminal 2 is installed into the receiving slot 10, the contact arm 231 protrudes from the top surface of insulating body 1 for electrical connection with a chip module. Referring to FIG. 10, the welding portion 243 exposes outside of the bottom surface of the insulating housing 1 and the bottom end of the welding portion 243 is over the bottom surface of the protrusion portion 111, which means a third predetermined distance exists between the bottom surface of the protrusion portion 111 and the circuit board . Soldering materials, such as a solder ball 3, is disposed between the welding portion 243 and the concave surface of the protrusion portion 111. When the protruding welding portion 243 is then soldered to the circuit board, some melted material is received between the circuit board and the bottom surface of the protrusion portion 111.

The electrical connector 100 and the terminal 2 of the present invention have the following advantageous characteristics.

1. The terminal 2 has two welding portions 243, and both the number of soldering points and soldering surface are increased for ensuring a firmer connection to the circuit board. Each inner edge 2432 of the welding portion 243 between the holding legs 24 is substantially arc-shaped. The arced inner edges 2432 between the holding legs, together with the protrusion portion 111 of the insulating housing 1, cooperatively define a claw structure that is capable of retaining a solder ball 3 in place. Furthermore, because the plane of the welding portion 243 is slanted to the base 21, the welding portion 243 generates a pushing force to the solder ball 3 against the protrusion portion 111, which further improves the holding capability of the soldering materials.

2. The holding leg 24 has a pair of sloping transition arms 241 separated by the second predetermined distance. When an external force is exerted, the sloping portion of the transition arms 241 absorbs the external force better, thus serving as a buffer to reduce oscillation. The stress transmitted to the welding portion 243 is therefore reduced to minimize risk of solder crack.

Figure 7:
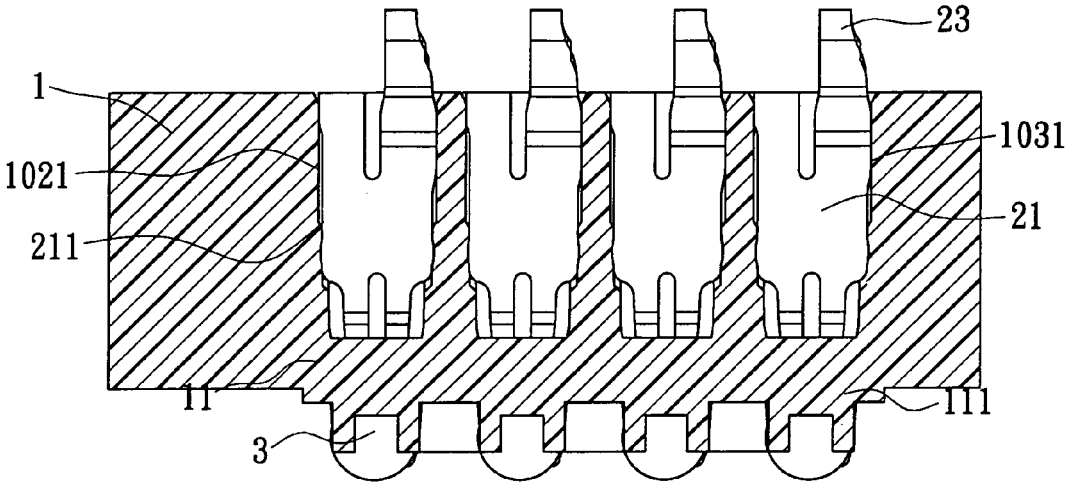
FIG. 7 is a cross-sectional view taken along the line A-A in FIG. 2.

3. Referring to FIG. 7, the two interference portions 211 engage tightly the second vertical portion 1021 and the third vertical portion 1031, which effectively reduces the lateral movement of the terminal 2 in the receiving slot 10.

Figure 9:
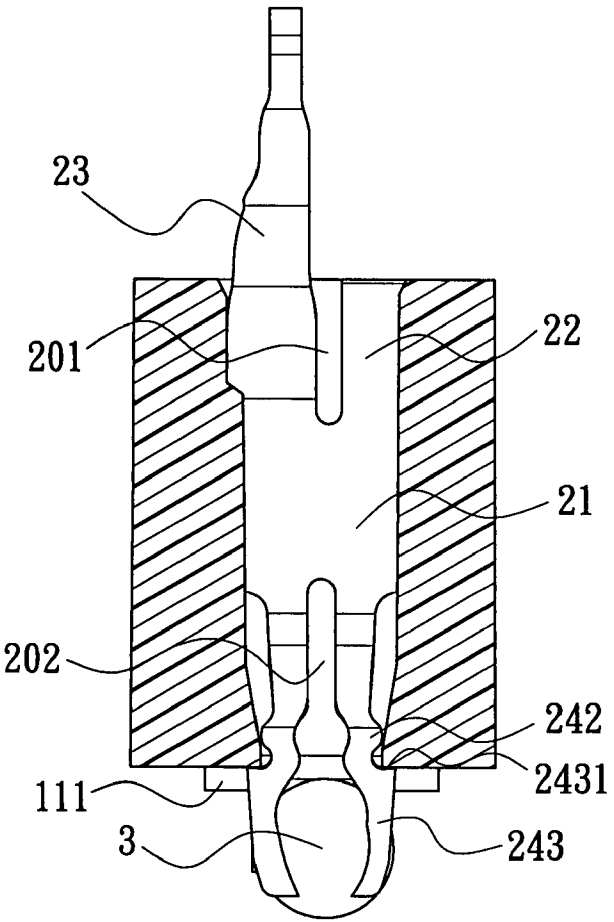
FIG. 9 is a cross-sectional view taken along the line B-B in FIG. 2.

4. Referring to FIG. 9, the pair of blocking portion 242, which is disposed near the bottom surface of the receiving slots, corresponds to the second sloping portion 1022 and the third sloping portion 1032 respectively. The lateral movement of welding portion 243 is limited, which is good for the solder ball held by the terminal 2.

5. Referring to FIG. 9, the shoulder 2431 is engaged to the bottom surface of the insulating housing 1 to prevent the terminal 2 from moving upwards under the external force, thereby establishing a firm connection between the terminal 2 and the circuit board.

6. Referring to FIG. 8, a part of the solder ball 3 entering the receiving space 2021 will be held firmly by the two hooks 2433, while another part of the solder ball 3 presses against the protrusion portion 111. Thus, the solder ball will not be easily dropped after installation.

7. As shown in FIG. 2, the free end of the flexible arm 23 of the terminal 2 in a row is situated between two adjacent flexible arms 23 of the corresponding terminals in a front adjacent row, and the free end of the flexible arm 23 of the terminal 2 in a row is situated right above the retaining portion 22 of the corresponding terminal in a front adjacent row. The staggered configuration of the receiving slots provides a distribution of the high-density terminals in the insulating housing 1. Also, because of the efficient arrangement, a longer contact arm 231 may be used. The flexibility of the contact arm 231 to the chip module is therefore enhanced. Higher density terminals and longer contact arms contribute to better transmission of electrical signals.

8. The funnel shape of the receiving slots 10 effectively restricts the movement of the holding leg 24, therefore enables a secure connection between the welding portion 243 and the circuit board.

9. The protrusion portion 111, having a concave groove facing the receiving slot 10, establishes a secure holding structure with the welding portion 243. The solder ball 3 is therefore held firmly between the protrusion portion 111 and the welding portion 243.

The description above only illustrates specific embodiments and examples of the present invention. The present invention should therefore cover various modifications and variations made to the herein-described structure and operations of the present invention, provided they fall within the scope of the present invention as defined in the following appended claims.

What is claimed is:

1. A terminal, received in a receiving slot of an insulating housing, comprising:

a base having an upper end and a lower end;

a flexible arm extending upward from the upper end of the base;

a retaining portion extending upward from the upper end of the base, wherein a first predetermined distance is between the flexible arm and the retaining portion;

a pair of holding legs, each holding leg comprising:

a transition arm extending obliquely and downward from the lower end of the base and a welding portion extending downward from the transition arm at a slanting angle;

wherein a second predetermined distance is defined between the two transition arms, wherein the pair of welding portions are co-planner and inclined toward the base; wherein the pair of welding portions form a retaining space therebetween to retain a solder ball; and wherein each of the welding portions is respectively formed with a substantially arc-shaped inner edge, wherein the inner edges between the two welding portions of the holding legs define a claw structure to retain the solder ball with the insulating housing.

2. The terminal of claim 1, wherein the transition arms extend from the base at a first angle.

3. The terminal of claim 2, wherein a block portion is disposed between the transition arm and the welding portion.

4. The terminal of claim 3, wherein the blocking portion protrudes from the holding leg.

5. The terminal as claimed in claim 1, wherein the welding portion comprises a hook.

6. The terminal of claim 1, wherein the welding portion further comprises a shoulder concaved from an outer edge thereof adjacent to the base, wherein the shoulder is protruded beyond an outer edge of the transition arm to be blocked against a bottom surface of the insulating housing.

7. The terminal of claim 1, wherein the flexible arm comprises a bending portion and a contact arm, the bending portion extends aslant upward to form the contact arm.

8. The terminal of claim 7, wherein the bending portion and the holding leg are disposed at the same side of the base.

9. The terminal of claim 2, wherein the first angle is an obtuse angle.

10. The terminal of claim 9, the welding portions of the holding leg are coplanar, wherein the angle between the plane of the welding portion and the plane of the transition arm is smaller than the first angle.

11. An electrical connector, comprising:

an insulating housing having a plurality of receiving slots, wherein the receiving slots are disposed in a staggered configuration;

a plurality of terminals, received in the receiving slots correspondingly, and each of the terminals comprising:

a base having an upper end and a lower end;

a flexible arm extending upward from the upper end of the base; and a retaining portion extending upward from the upper end of the base, wherein a first predetermined distance is between the flexible arm and the retaining portion; and a pair of holding legs, each holding leg comprising: a transition arm extending obliquely and downward from the lower end of the base; and a welding portion extending downward from the transition arm at a slanting angle with respect to the transition arm; wherein a second predetermined distance is defined between the two transition arms, wherein the free end of the flexible arm of the terminal in a row is situated between two adjacent flexible arms of the corresponding terminals in a front adjacent row; wherein the pair of welding portions form a retaining space therebetween to retain a solder ball; and wherein the insulating housing protrudes a plurality of protrusion portions from a bottom surface thereof adjacent to the receiving slots correspondingly and faces toward the welding portions correspondingly, wherein each one of the protrusion portions and each two welding portions define a secure holding structure to hold firmly the solder ball there between.

12. The electrical connector of claim 11, wherein a flange extends from the top surface of the insulating housing.

13. The electrical connector of claim 11, wherein the free end of the flexible arm of the terminal in a row is situated right above the retaining portion of the corresponding terminal in a front adjacent row.

14. The electrical connector of claim 11, wherein the receiving slot is funnel-shaped, and formed with an upper opening and a lower opening, wherein the upper opening is larger than the lower opening.

15. The electrical connector of claim 11, wherein the insulating housing protrudes a plurality of protrusion portions from a bottom surface thereof adjacent to the receiving slots correspondingly and faces toward the welding portions correspondingly, wherein each one of the protrusion portions and each two welding portions define a secure holding structure to hold firmly the solder ball therebetween.

16. The electrical connecter of claim 11, wherein the transition arms extend from the base at a first angle, the welding portions of the holding leg are coplanar, wherein the angle between the plane of the welding portions and the plane of the transition arm is smaller than the first angle.

17. The electrical connector of claim 15, wherein each of the protrusion portions is formed with a concave surface facing the receiving slot to define a secure holding structure between the welding portion and the protrusion portion, whereby the solder ball is therefore held firmly between the protrusion portion and the welding portions.

18. The electrical connector of claim 15, wherein each free end of the two welding portions protrudes a hook toward to each other, the hooks and the protrusion portions hold the solder ball corporately therebetween to avoid from dropping after installation.

* * * * *